United States Patent [19]

Davis et al.

[11] 3,999,987

[45] Dec. 28, 1976

[54] COLOR REPRODUCTION METHOD

[75] Inventors: Howard C. Davis; Harold E. Trumbull; Charles A. Cummings, all of Columbus, Ohio

[73] Assignee: Xerox Corporation, Stamford, Conn.

[22] Filed: Aug. 25, 1971

[21] Appl. No.: 174,945

Related U.S. Application Data

[62] Division of Ser. No. 830,286, June 4, 1969.

[52] U.S. Cl. ..... 96/1.2; 96/1.4

[51] Int. Cl.[2] ..... G03G 13/22

[58] Field of Search ..... 96/1.2, 1.4

[56] References Cited

UNITED STATES PATENTS

| | | | |
|---|---|---|---|
| 2,986,466 | 5/1961 | Kaprelian | 96/1.2 |
| 3,185,777 | 5/1965 | Rheinfrank | 96/1.4 X |
| 3,413,063 | 11/1968 | Young | 96/1.4 X |
| 3,464,818 | 9/1969 | Waly | 96/1.4 X |
| 3,503,776 | 3/1970 | Gundlach | 96/1.4 X |
| 3,531,195 | 9/1970 | Tanaka et al. | 96/1.2 |
| 3,694,069 | 9/1972 | Yamaji et al. | 96/1.2 X |

*Primary Examiner*—Roland E. Martin, Jr.

[57] ABSTRACT

A multi-color electrostatic printing machine having processing components adapted to produce an image for each color of an original being copied, individual color developing units for effecting development of the corresponding images and a program arrangement for coordinating in timed sequence the operation of the processing components and the transfer of each developed image in superimposed relationship upon sheets of paper.

4 Claims, 11 Drawing Figures

COLOR REPRODUCTION METHOD

This is a division of application Ser. No. 830,286, filed June 4, 1969.

This invention relates to a reproduction system and more particularly to a direct color reproduction system having components arranged and programmed to effect automatically the high speed color processing and the production of color copies without the use of intermediates and which are acceptable renditions of originals.

In recent years there have been various attempts in the electrostatic printing field at color reproduction processes employing imaging techniques and development processes that are described as being capable of producing faithful color renditions of multi-colored originals. These color reproduction processes generally embody principles which, by their very nature, are at best a compromise to effect a particular color reproduction; that is, any particular color may not include all or the precise coloration desired. In addition, the disclosed color reproduction systems using electrostatic printing techniques are relatively slow in processing speeds, as each color production must be controlled in a precise manner and in sequence with the production of other colors in order to insure that each color and the mixes of two or more colors are true. In order to accomplish acceptable mixes, the steps for each color printing process must be controlled with exactness, both as to time and as to completeness.

In many of the color processing disclosures, there is employed a complete printing apparatus for each color being reproduced. This may involve a system employing three, four or five complete reproduction systems that are precisely controlled by programmers, not only for each color rendition system per se, but also for the cooperative effect between the systems. The resultant color-to-color printing machine is relatively large, costly and complex. Furthermore, resultant color renditions have not always proven to be acceptable.

It is a principal object of the present invention to improve color reproduction processes utilizing conventional components in a novel arrangement and programmed so as to effect color reproduction at relatively high speeds.

Another object of the invention is to produce electrostatic color images from a colored original utilizing a minimum of parts and time thereby minimizing expenditures for individual color copies.

These and other objects of the present invention are obtained by means of an endless panchromatic photoconductor belt arranged to be moved in an endless path having at least two flat runs. One of the flat runs is utilized at the exposure station at which the original is exposed by means of flash, full-frame exposure. Each original being reproduced is subjected to a series of successive, multiple exposures, and a light filter device, having a separation color filter for each color desired to-be-reproduced, is utilized and arranged to present one filter during each of the exposures so that the original is exposed once for each color rendition. Another flat run is utilized at a development station for developing the resultant electrostatic latent image. At this station there is positioned a plurality of in-line developing devices each of which is adapted to develop an image with a corresponding subtractive color material. A programming arrangement is utilized along with the plurality of color filters for exposing the original a plurality of times, one for each required color wherein successive images, each of a different color, are produced and wherein the plurality of latent images are presented in succession to the developing station. The programmer also controls the activation of each of the developing devices for respectively developing the latent images by a developing device. The programmer also includes means for controlling the disposition of a sheet of paper so that the sheet is brought into transfer relationship with the developed images on a recirculating basis; that is, one application of the sheet of paper to the photoconductive belt for each different color image to be transferred.

For a better understanding of the invention as well as other objects and further features thereof, reference is had to the following detailed description of the invention to be read in conjunction with the accompanying drawings wherein.

Figure 1:
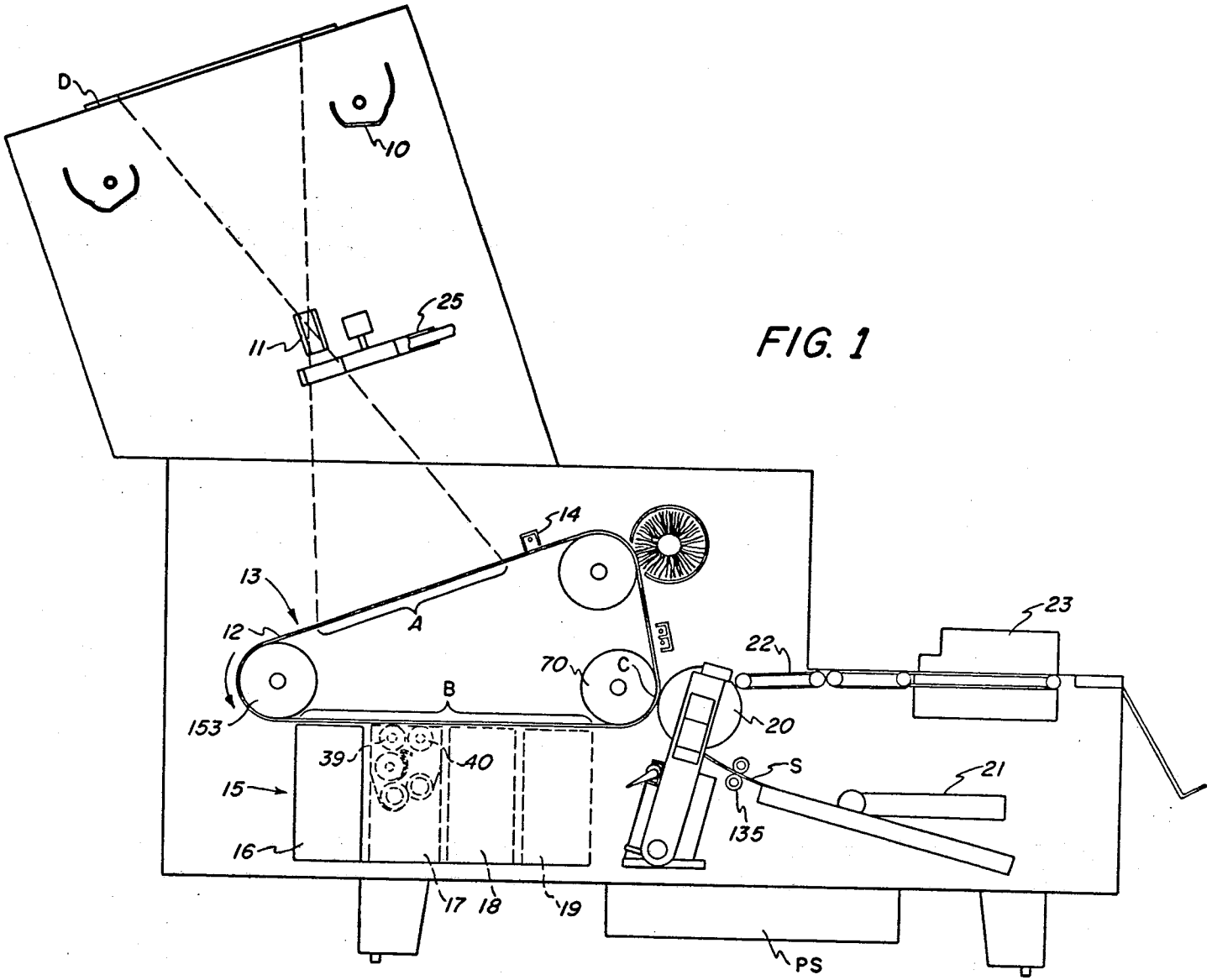
FIG. 1 is a schematic view of a reproduction machine showing various electrostatic processing components.

For a general understanding of the illustrated copier/reproduction machine, in which the invention may be incorporated, reference is had to FIG. 1 in which the various components for the machine are schematically illustrated. As in all electrostatic systems as well as a xerographic machine of the type illustrated, a light image of a document to be reproduced is projected onto the sensitized surface of a xerographic plate to form an electrostatic latent image thereon. Thereafter, the latent image is developed to form a xerographic powder image, corresponding to the latent image on the plate surface. The powder image is then electrostatically transferred to a support surface to which it may be fixed by a fusing device whereby the powder image is caused permanently to adhere to the support surface.

In the illustrated machine, an original D to be copied is placed upon a transparent support platen fixedly arranged relative to an illumination lamp assembly 10 positioned at the upper end of the machine as viewed in FIG. 1. While upon the platen, a programming system for the machine activates a lamp control circuit to cause successive energization of the lamps in the lamp assembly 10 for impinging light rays upon the original thereby producing image rays which when acted upon by separation filters correspond to the color informational areas on the original. The image rays are projected by means of an optical lens system 11 for exposing the photosensitive surface of a xerographic plate at the exposure station A, the plate being in the form of a flexible photoconductive belt 12 arranged on a belt assembly generally indicated by the reference numeral 13.

The photoconductive belt assembly 13 may be mounted upon the frame of the machine and is adapted to drive the selenium belt 12 at a constant rate in the direction of the arrow as shown in FIG. 1. During this movement of the belt, the light imaging rays of an original are successively flashed full frame upon the surface of the belt. The belt structure utilized comprises a layer of photoconductive insulating material such as selenium on a conductive backing that is sensitized prior to exposure by means of a suitable charging corona generator device 14.

The flash exposure of the belt surface to the light image discharges the photoconductive layer in the areas struck by light, whereby there remains on the belt an electrostatic latent image for each exposure, each being in image configuration corresponding to the light image projected from the original D on the supporting platen through the corresponding separation filter. As the belt surface continues its movement, the latent electrostatic images pass through a developing station B at which there is positioned a developer assembly generally indicated by the reference numeral 15 and where the belt is maintained in a flat condition. The developer assembly 15 comprises a plurality of developing devices 16, 17, 18 and 19 each of which contains a different color developing material to provide individual development of the electrostatic images.

The successively developed electrostatic images are transported by the belt to a transfer station C whereat a sheet of copy paper is moved at a speed in synchronism with the moving belt in order to accomplish transfer of the developed images. There is provided at this station a sheet transport mechanism in the form of a transfer drum 20 adapted to support a sheet of paper and to carry the same into image transfer relationship with the belt 12 once for each image transfer operation, as will be described in more detail hereinafter. A sheet of paper S from a paper handling mechanism, generally indicated by the reference numeral 21, is transported into position upon the drum 20 where it is supported during the image transfer function. The transfer of the developed image from the selenium belt surface to sheet material is effected by means of an electrical bias of the opposite polarity as the triboelectric charge on the developing particles utilized in image development being applied to the transfer drum 20 at the point of contact between the sheet and selenium belt as the sheet passes the transfer station C.

After the sheet is stripped from the transfer drum 20, it is conveyed by conveyor 22 into a fuser assembly generally indicated by the reference numeral 23 wherein the developed and transferred powder image on the sheet material is permanently affixed thereto. After fusing, the finished copy is discharged from the apparatus at a suitable point for collection externally of the apparatus.

It is believed that the foregoing description is sufficient for the purposes of this application to show the general operation of an electrostatic copier constructed in accordance with the present invention.

As previously stated, in order to effect development of each of the latent electrostatic images on the photoconductive belt 12 that comprise a series of exposures of a single original, the development system 15 includes four developer units 16, 17, 18 and 19, which individually and separately are activated to coact with the belt 12 at the development station. While one of the developer units is activated during development thereby, the other developer units are rendered inactive so as not to interfere with the developing process of the activated unit. At the development station B, each latent electrostatic image on the surface of the belt, which at this station is in the form of a flat horizontally disposed run, is developed to form a powder image of a particular color in image configuration corresponding to that color component in the original.

The electrostatic color-to-color reproduction machine of FIG. 1 employs the substractive color reproduction process utilizing separation filters red, green, blue and neutral density. With the belt 12 being a panchromatic photoconductor, subtractive acting toners yellow, cyan, magenta, are utilized respectively to effect development of the latent electrostatic images produced in conjunction with the separation filters red, green, and blue.

Figure 10:
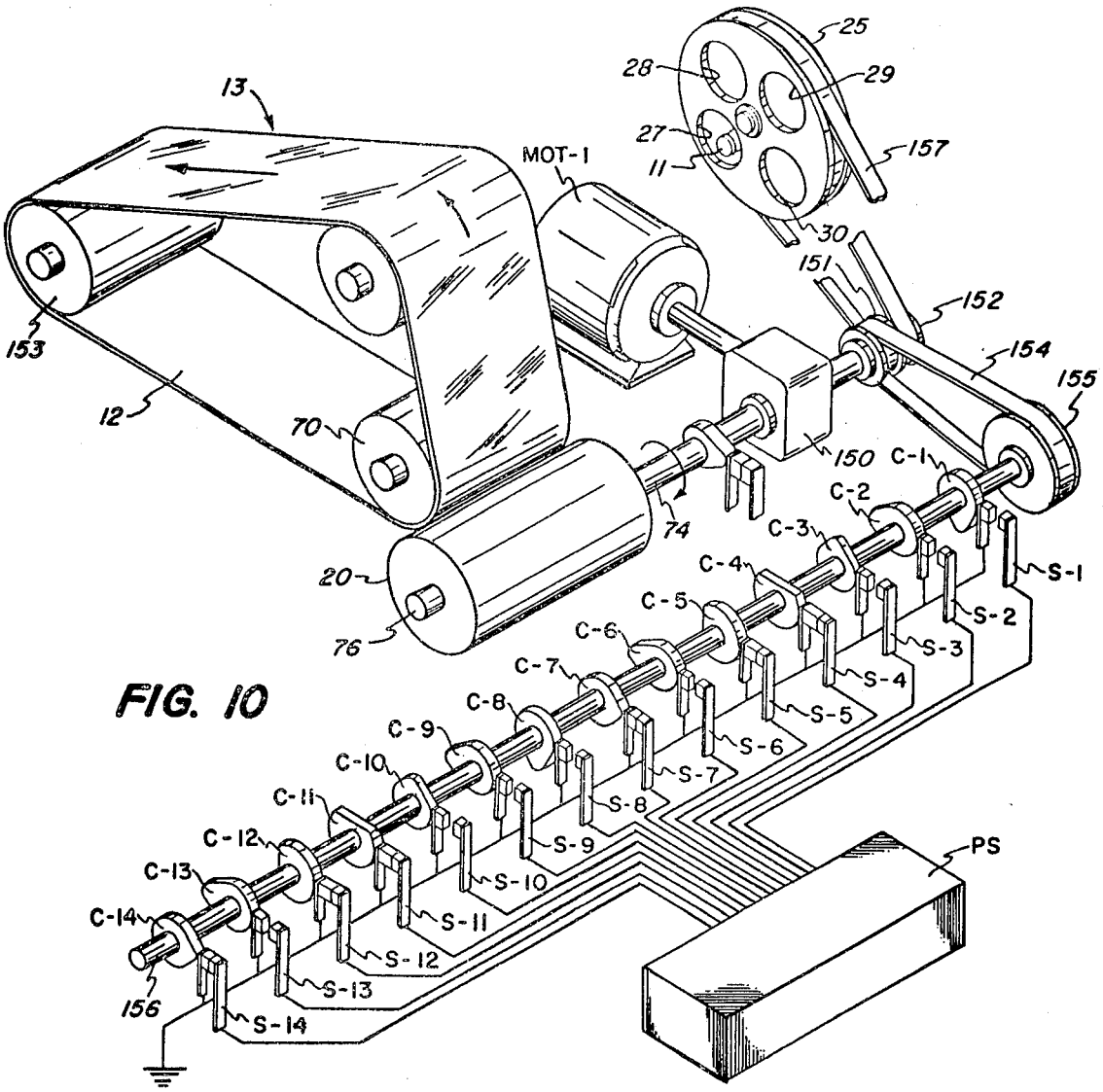
FIG. 10 is a schematic isometric illustration of a programming mechanism for controlling imaging and processing of the machine of FIG. 1.
Figure 11:
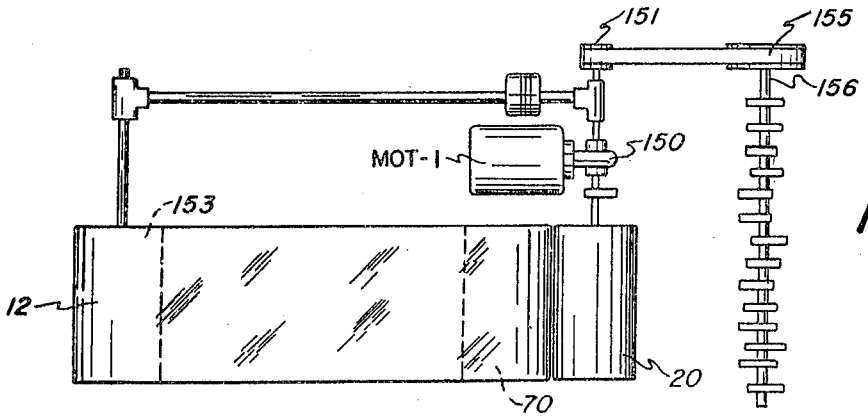
FIG. 11 is a schematic view of the programming arrangement of FIG. 10 showing additional components therein.

The separation filters are mounted in a filter disc 25 formed for indexing action as a pulley 26 connected by a suitable belt to a drive system to be described hereinafter. As shown in FIG. 10, the disc 25 is formed with four apertures into which is suitably mounted a blue filter 27, red filter 28, green filter 29 and a neutral density filter 30. As will be described hereinafter, a programmed drive system is adapted to effect rotation of the disc 25 in timed sequence with flash illumination of the original D, this indexing action resulting in a sequence of movement wherein the blue filter is positioned into optical alignment with the lens 11 just prior to the first exposure of the document. After this first illumination of the original, the disc 25 is indexed to present the red filter 28 in optical alignment with the lens 11 for a second exposure. A third index action is produced to bring the green filter 29 before the lens 11 for a third exposure of the original. A fourth indexing action of the disc 25 is provided in order to bring the neutral density filter 30 in alignment with the lens 11 for exposure of the photoconductive belt to light rays of the original for conventional black and white reproduction. For this use, the color developer units will be inactivated and only black and white reproduction will be operative.

For each color-to-color reproduction cycle, the original is exposed three times, thereby producing three latent electrostatic images on the surface of the belt 12. Each of the three latent images is representative of a particular color in the document either in its pure form or for a color mix in the original. The relative spacings of the three latent images on the belt 12 are fairly close, being determined and provided by the programming system for the machine. As the lead image is moved into the developing station B, the color unit, which is adapted to provide development with a subtractive toner relative to the separation filter used for the exposure of this image, is activated. In the illustration being described, the lead latent image produced from the exposure of the original through the blue filter 27, will be developed by means of the developer unit 16 carrying yellow color toner particles in order to provide yellow development or for a mixture including yellow corresponding to yellow coloring or mixtures thereof present in the original. During this development by the yellow unit 16, the developer units 17, 18 and 19 are held in an inactive condition. After the first electrostatic latent image has been developed and moves out of the influence of the developer unit 16, the second latent image immediately behind the first image is moved into developing position relative to the cyan developer unit 17, which is activated for this purpose. The unit 17 will develop the second latent image which was produced by means of the illumination of the original through the red filter 28 and will effect the development of this cyan color with cyancolor toner particles for those areas of the original that are cyan or include cyan in a mixture. During this second development action by the unit 17, the other units 16, 18, and 19 are maintained in an inactive condition.

After the second latent image has been developed and moved out of the influence of the unit 17, the third electrostatic latent image which was produced by the illumination of the original through the green filter 29 is moved into developing position relative to the magenta developer unit 18. During movement of the third latent image past the unit 18, it is developed with magneta color toner particles for the magenta areas on the original and those areas including magenta in a mixture thereof. In the event that only black and white copies of the original are desired, electrostatic latent images produced by the illumination of the original through the neutral density filter 30 will be developed by the developer unit 19 containing black toner particles for developing those areas of the original which are black or of varying shades of black.

Each of the three powder images produced by the three color developer units is transferred in succession to a sheet of support material mounted on the transfer drum 20. Further details of the operation of the transfer drum and the additional programming of the reproduction process will be described in succeeding paragraphs relating to the programming for the machine.

The four developer units 16, 17, 18 and 19 are identical except for the particular toner being utilized. The units are of a multiple-magnetic brush type and, since they are identical only one; namely, cyan unit 17 will be described in detail.

MAGNETIC DEVELOPING UNIT

Figure 2:
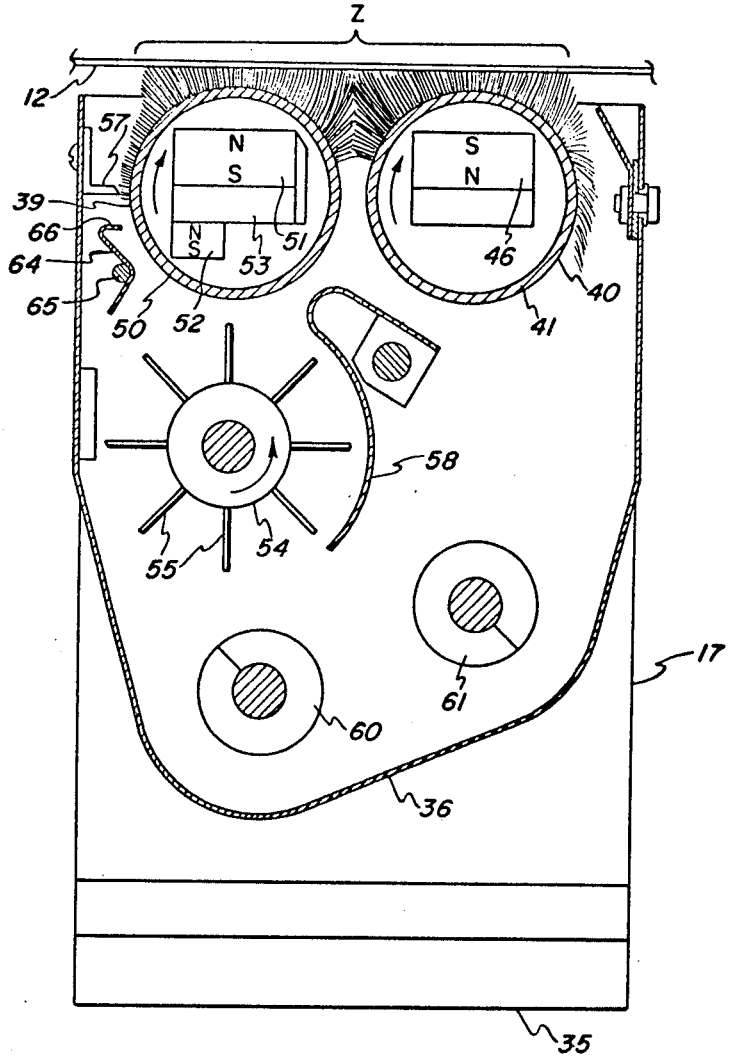
FIG. 2 is an enlarged cross-sectional view of one of the developing units taken along a line parallel to the path of movement of a photoconductor element.
Figure 3:
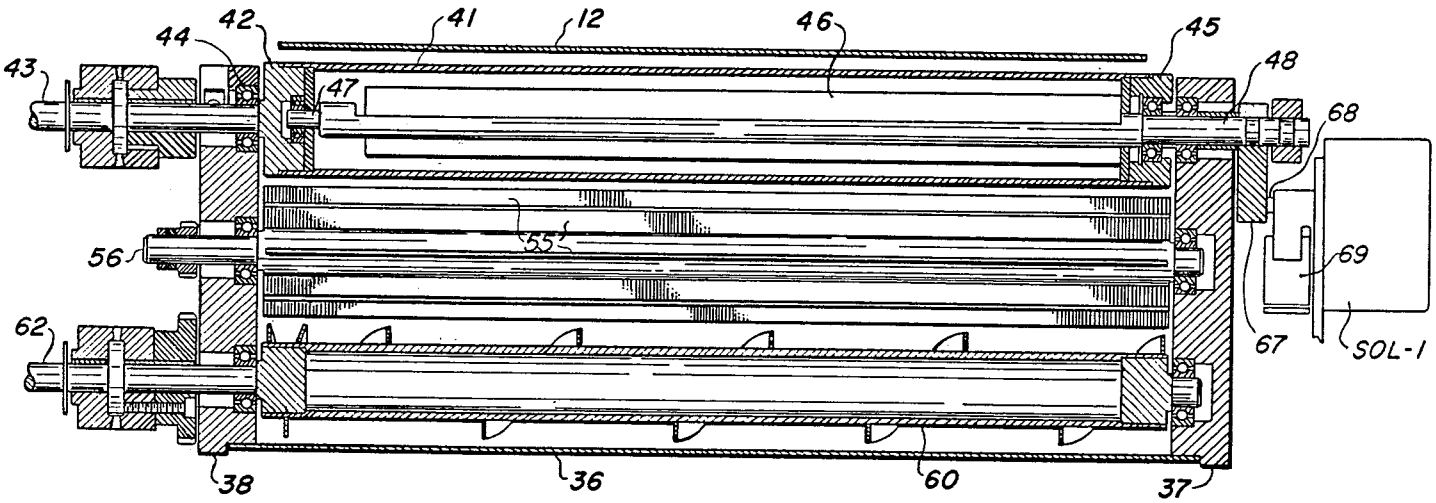
FIG. 3 is a cross-sectional view of the developing unit taken along a line normal to the path of movement of the photoconductor.

As shown in FIGS. 2 and 3, the unit 17 comprises aa box-like structure 35 having a rectangular cross section and a length extending beyond the width of the belt 12. Within the box-like structure 35, there is suitably mounted a developer container formed with a thin walled developer housing 36 closed at its ends, end walls 37 and 38. The housing 36 contains developing material comprising carrier beads made from magnetizable material and color toner particles which adhere electrostatically in great numbers to the carrier beads. Mounted for rotation within the developer housing 36 are two magnetic brushes 39 and 40 positioned with their axes in parallel and below the selenium belt 12.

The magnetic brush 40, comprising outer cylinder 41 made of magnetizable material and extending almost the length of the housing 36, is mounted for rotation within the structure 35. One end of the cylinder 41 is closed by a cap 42 which supports a drive shaft 43 in axial alignment with the cylinder and is mounted in bearings 44 on the end plate wall 38. The other end of the cylinder is provided with a cap 45 having a central opening therein. Within the cylinder 41 there is positioned an elongated magnet bar 46 extending nearly the full length of the cylinder and being mounted therein by means of a stub shaft 47 rotatably supported in the end cap 42 and a drive shaft 48 extending through and rotatably mounted in bearings held within the central opening formed in the cap 45. The shaft 48 extends through and is suitably journaled in the end wall 37 so as to be rotated by an external control device as will be described hereinafter. In operation during a development cycle, the brush cylinder 41 is rotated by way of the drive shaft 43 and the magnet 46 remains stationary.

The second magnetic brush 39 comprises a cylinder 50 having a length and diameter equal to the cylinder 41. Within the brush cylinder 50 there is mounted a main magnet bar 51 which is supported in fixed position relative to its enclosing rotatable cylinder. This is accomplished by the use of shafts (not shown) mounted at both ends of the magnet bar 51 and projecting through openings in end caps (not shown) that are used to close and support the ends of the cylinder 50. Such caps and shafts are similar to the cap 42 and the shaft 47 at one end and the cap 45 and shaft 48 at the other end. One of the shafts would be fixed in order to maintain the magnet bar 51 in a fixed position during rotation of the cylinder 50. A second elongated magnet bar 52 is mounted within the cylinder 50 and is attached to a spacer bar 53 secured to the lower surface of the magnet bar 51. The polar orientation of the magnets 46 and 51 are indicated in FIG. 2 and are arranged so that magnetic lines of flux project through the walls of the respective cylinders 41, 50 and across the surface of the belt 12 as it moves adjacent the brushes 39, 40.

As shown in FIG. 2, the peripheral walls of the brush cylinders 41 and 50 are relatively close to each other. During a development cycle when both cylinders are rotating in unison and with the magnets 46 and 51 held stationary, the brush bristles produced by the use of magnetizable carrier beads in the developing material used in the unit 17 will form on the upper region of the cylinder 50 between this region and the undersurface of the selenium belt 12. These bristles remain formed during the developing cycle, being produced by the magnetic field of the magnet 51 beginning slightly before reaching the closest distance between the cylinder 50 and the belt 12. When the bristles are moved out of the influence of this magnet beyond the closest distance between the belt and the cylinder, they are picked up by the magnetic field of the magnet 46 which is stronger at this point than the diminished strength of the magnetic field attributed to the magnet 51 and carried therealong during rotation of the cylinder 41 until they reach a point beyond the development zone Z when the carrier beads and toner particles drop off the cylinder and back into the housing 36.

During movement of the carrier beads and toner through the development zone Z, the magnetic bristles and, therefore, the development material, is in the form of a "magnetic blanket" extending the entire width of the zone Z wherein the material is disposed or available for developing purposes. It will be apparent that the width of the development zone Z is larger than the sum of the individual development zones for each of the magnetic brushes 39, 40. One or two additional brushes may be added in the same arrangement in order to extend the dimensions of the magnetic blanket and therefore the development zone which will always be larger when so combined than the sum of the development zones for the brushes.

Also mounted within the development housing 36 and below the magnetic brush 39 is an impeller 54 having a plurality of blades 55 radially extending therefrom and having one end rotatably mounted in the end wall 37 and its other end terminating in a drive shaft 56 which in turn is rotatably mounted on and extends through the end wall 38. During a development cycle the impeller 54 is rotated in the direction shown by the arrow in FIG. 2 and serves to carry and throw development material toward the lower surface of the magnetic brush 39. The development material so thrown is picked up by the pickup magnet 52 which commences the formation of bristles on the cylinder 50. As this cylinder rotates, the newly formed bristles come under the influence of the main magnet 51.

A clipping blade 57 is secured to the upper wall of the housing 36 and extends radially toward the cylinder 41 being spaced from the periphery thereof a short distance equal to the length of the bristles to be formed on this magnetic brush. Upon rotation of the cylinder 50 for carrying the magnetic bristles toward the development zone Z, the blade 57 clips the tops of the magnetic bristles for presenting optimum lengths of the bristles to the belt 12. A curved baffle plate 58 is secured interiorly of the housing 36 and extends along for a length equal to the length of the impeller 54 with the center of curvature coincident with that of the impeller. The baffle assists the paddle blades of the impeller in forming large increments of developing material to be moved from the lower region of the housing 36 to the vicinity of the pickup magnet 52 whereat some of the material is formed into magnetic brush bristles.

A pair of augers 60, 61 are mounted in the lower region of the housing 36 for insuring continual mixing of the particles that comprise the developed material and for insuring proper quantities at all times. Each of the augers is suitably mounted at one end on the wall 37 while the other ends terminate in a drive shaft 62 which extends through and supported on the end wall 38. A suitable drive mechanism (not shown) may be connected to the shaft 62 and be activated when the machine is in its operative condition.

The magnetic developer unit 17 is also provided with devices which will control the developing action of the unit, and in such a way that the action may be switched on and off as rapidly as possible. Since the development zone Z is relatively wide and more than one magnetic brush is being controlled, the time period in which it takes the "magnetic blanket" over both brushes to become inoperative is shortened by having both brushes controlled separately. To this end, the first of the magnetic brushes; namely, the brush 39 is provided with a gate element 64 fixed to a shaft 65 for rotation therewith. The gate 64 is formed with an edge 66 extending radially relative to the cylinder 50, and upon the rotation of the shaft 65, is adapted to engage the adjacent periphery of this cylinder. This action serves to scrape off instantly any magnetic bristles on the cylinder 50 thereby preventing the transport of development material beyond the edge 66 and consequently terminating the development action by the magnetic brush 39 except for the developing material still on the brush the instant before gating. This control action of the shaft 65 is made effective by the overall machine programming system, as will be described hereinafter.

Gating action of the other magnetic brush 40 is provided by the quick rotation of the magnet 46 for approximately 90° from its illustrated position. As previously stated, the magnet 46 is provided with a shaft 48 that extends externally of the developer housing 36. As shown in FIG. 2, the shaft 48 is rotatably connected to a rocker arm 67 which has a pin 68 extending therefrom at one end to be engaged by a rocker arm 69 arranged to be swung in either direction upon activation of a rotary solenoid SOL-1. This solenoid is suitably mounted on the end wall 37 and connected electrically to the programming system to be described hereinafter. Upon energization of the solenoid SOL-1, the rocker arm 69 is rocked in one direction for producing rocking of the rocker arm 67 with corresponding rotation of the shaft 47. This complete action involves only a very small increment of time. Rotation of the magnet 46 will remove its magnetic influence upon the magnetic carrier beads attempting to bridge across the gap between the magnetic brushes 39, 40. A machine programming system will effect simultaneously activity of the shaft 65 and the shaft 48 for causing near simultaneous gating of the two magnetic brushes. In this event, only that developing material which forms on the brush 39 beyond the edge 66 will be involved in further development before most of the material falls through the space between the cylinders 41, 50 and, for the brush 40, that development material which was conveyed from the magnetic brush 39 just prior to a gating requirement will be involved in further development. In this manner, the length of time needed to remove all residual developing material from the "magnetic blanket" on and between the brushes 39 and 40 when gating is programmed is effectively that time needed to remove the material from just one of the brushes. As opposed to the use of a magnetic conveyor belt between two rollers, an arrangement which cannot be effectively gated to on-off conditions in acceptable short periods of time, the present magnetic blanket concept, especially with the employment of many individual magnetic brushes, has the advantage that the gating periods for the entire coverage of the blanket is effectively the same for only one of the brushes utilized.

While only one of the magnetic belt units have been described in detail, it will be understood that the other units 16, 18 and 19 are identical to the unit 17 and differ only in the color of the pigmented toner utilized. Each unit has its own control solenoid SOL-1 and drive systems for the shafts 43 to rotate the corresponding cylinders 41, 50 and for rotating the augers 60, 61. For each unit, when the solenoid SOL-1 has been energized for a gating operation and after all residual developing material has been removed from the cylinders, their rotation will be terminated.

IMAGE TRANSFER DRUM

After development, each image of the series of color responsive images formed and developed on the selenium belt 12, or in the case of black and white reproduction, each of the white light exposed images is moved out of the development station B and carried to the transfer station C. In this station, the belt 12 is carried around a roller 70 which forms one of the three rollers of the belt assembly 13. Transfer occurs at the line on the belt 12 resulting when the transfer drum 20, which serves as a biased electrode is in contact with the adjacent surface thereof as it is moved about the roller 70.

The transfer drum 20 is normally held away from the selenium belt 12 by means of a spring retaining force and upon a control signal from the programming system for the machine, will energize a solenoid for overcoming the spring force and to force the drum against the belt. In this manner, the operation of the transfer drum is failsafe; that is, in the event of power failure or machine malfunctions, the drum will be normally moved into position of safety relative to the more delicate structure of the selenium belt.

Figure 4:
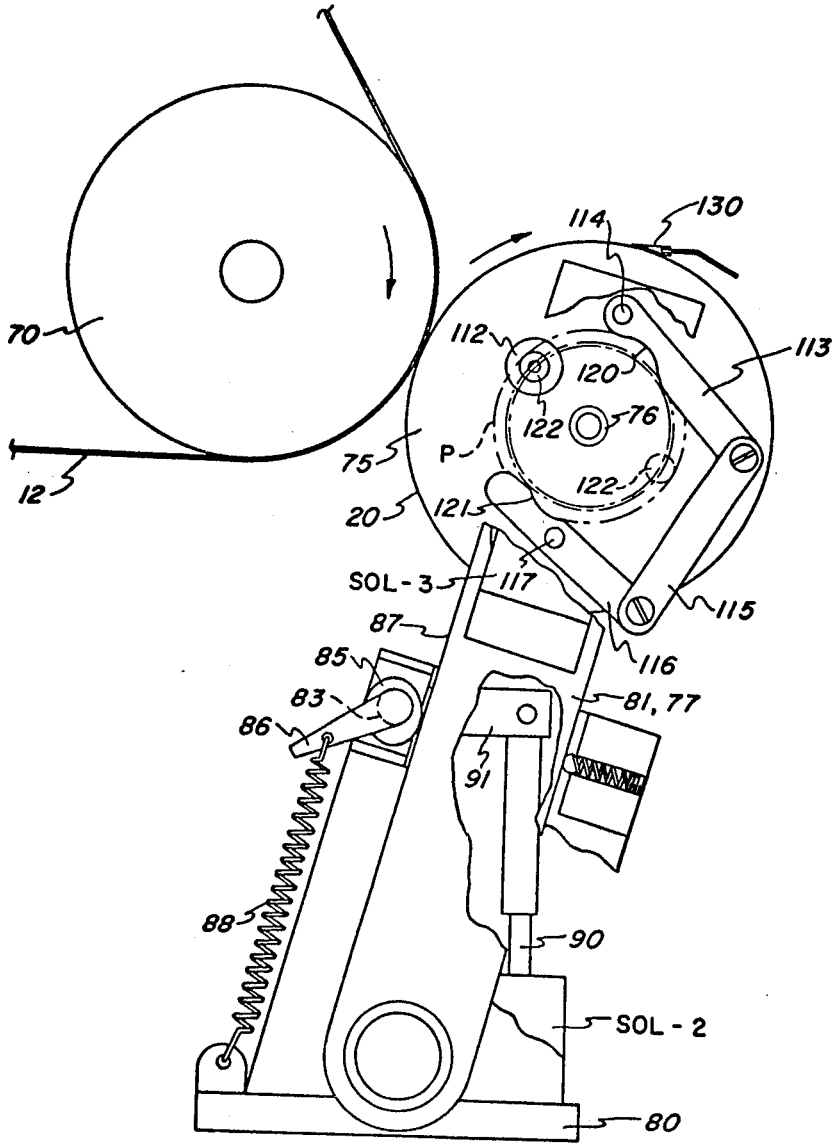
FIG. 4 is an enlarged view with parts broken away of the transfer drum utilized in the present invention in one condition of operation.
Figure 5:
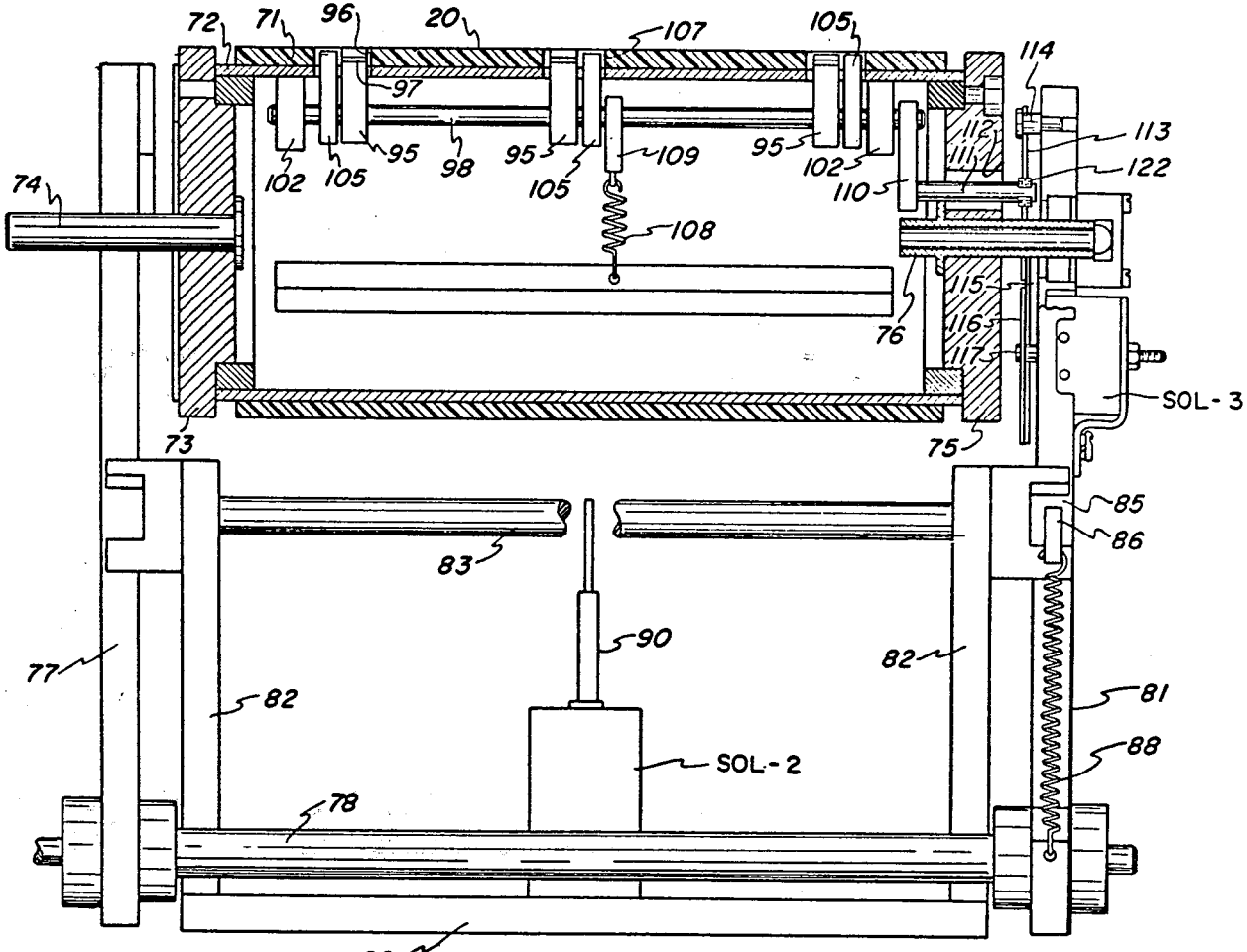
FIG. 5 is a longitudinal cross-sectional view of the transfer drum and supporting structure.

The drum 20 comprises a metallic cylinder mounted on two independently swinging arms and having an electrically conductive rubber blanket fixed therearound and connected to a suitable source of electrical current for image transfer purposes. As shown in FIGS. 4 and 5, a rubber coating blanket 71 is applied to a metallic cylinder 72 and is preferably made of rubber having a resiliency such that with light pressure being applied thereto while in contact with the belt 12, there will be a very slight flattening of or identification into the rubber for enhancing image transfer.

One end of the metal cylinder 72 is closed by an end cap 73 having a drive shaft 74 mounted centrally thereof. The other end of the cylinder 72 is also closed by a cap 75 which includes a centrally positioned hollow shaft 76. Means are provided for supporting the drum 20 by way of its supporting shafts 74, 76, which will permit movement of the drum into its two controlling positions. For this goal, the shaft 74 is suitably journaled on one end of an arm 77 which is rotatably supported at its other end on a shaft 78 secured to the frame 80 of the machine with its axis parallel to the axis of the drum. Similarly, the shaft 76 extends through and is journaled on one end of an arm 81 which is similar to the arm 77 and which is also journaled upon the shaft 78. The machine frame 80 is provided with vertically extending plates 82 for supporting a shaft 83 in a position parallel to the axis of the drum and the shaft 78 and to one side of one edge of each of the arms 77, 81.

At each end of the shaft 83 there is formed a cam 85, only one of which is shown in the drawings, and at one end of the shaft adjacent the cam there is also provided an integral lever 86. Both cams 85 are adapted to engage the adjacent edges 87 of the arms 77, 81 for forcing these arms to rotate about their common shaft 78 during slight rotation of the shaft 83. With the cams 85 having slight camming surfaces, this rocking movement of the arms is slight, being sufficient to disengage contact between the roller 20 and the belt 12. A coil spring 88 is held in tension between one end of the lever 86 and the machine frame 80 for normally tending to rotate the cams 85 against the arms in a direction to force the drum 20 away from the belt 12 (clockwise rotation of the arm 77, 81 in FIG. 4).

In order to overcome the spring force of spring 88, and to enable the drum 20 to contact the belt 12 for the image transfer function, there is provided a solenoid SOL-2 for rotating the shaft 83 in a direction opposite that produced by the spring 88. The solenoid SOL-2 is secured to the machine frame 80 and includes a plunger 90 pivotally connected to a link arm 91 secured to the shaft 83. As shown in FIG. 4, the link arm 91 is on the other side of the shaft 83 from the lever 86 so that upon energization of solenoid SOL-2, which results in the pull-in drive motion of the plunger 90, will overcome the spring force and cause rotation of the shaft 83 in a direction opposed to the spring action. This energization in effect will cause the arms 81, 77 to rotate in a counterclockwise direction and allow the drum 20 to engage the belt 12.

The transfer drum 20, in serving as an image transfer arrangement, is capable of registering and supporting a sheet of transfer material for either one transfer cycle or for recirculating the sheet through a plurality of transfer cycles. As previously described, the original D is exposed three times in order to produce a series of three latent electrostatic images each of which is developed in sequence and made ready for transfer. In order to make a single color reproduction of the original, the three developed images are transferred individually and to the same sheet of transfer material.

In order to effect precise registration and positioning of sheets of transfer material upon the drum 20, there is provided a plurality of registration elements 95 mounted within and for movement radially of the drum. To permit registration, the elements extend through openings 96 formed in the periphery of the drum surface, the openings being in a line parallel to the axis of the drum. Each of the elements 95 has a flat rectangular configuration and is formed with an outward extending projection 97 which is movable radially with the elements from a position within the periphery surface of the drum to two positions slightly outwardly of the periphery of the drum. When in use, the leading edge of a sheet S engages the elements 95 immediately outwardly of the projections 97 upon which the edge will be held during recirculation of the sheet (see FIG. 7).

Figure 7:
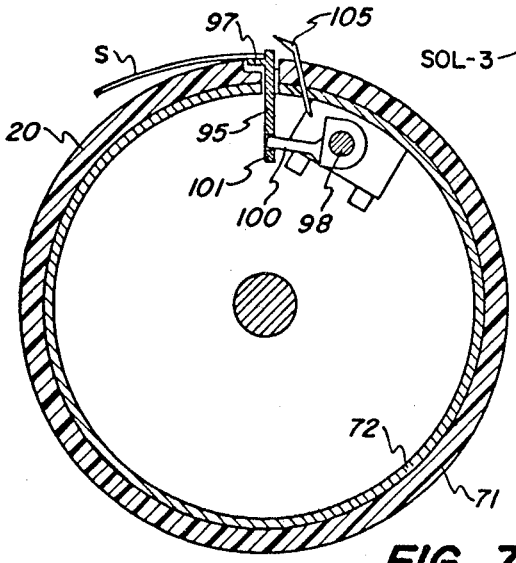
FIG. 7 is a cross-sectional view of the drum showing registration of a sheet of transfer material.
Figure 8:
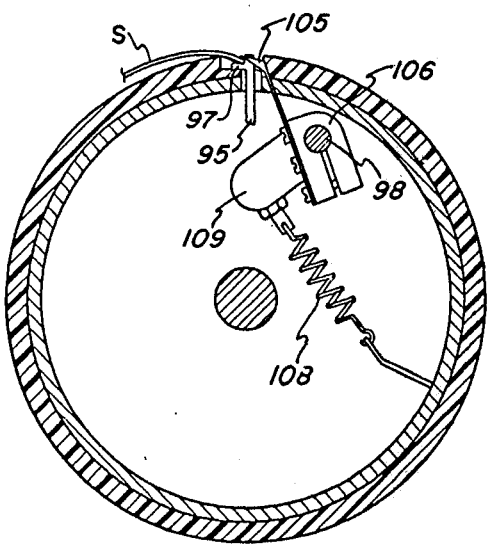
FIG. 8 is a cross-sectional view of the drum showing the sheet gripping mechanism in a gripping condition.

Radial movement of the elements 95 is provided by means of a shaft 98 mounted for rotation within the drum working in conjunction with drive rods 100 secured to the shaft and which are adapted to be slidably held within apertures 101 formed at the innermost ends of the elements. The shaft 98 is supported and journaled upon the inner surface of the cylinder 72 by means of bearing blocks 102, and upon rotation of the shaft 98 the rods 100 will be swung therewith for causing the elements 95 to move outwardly or inwardly as the case may be, relative to the axis of the drum 20. In operation, the elements 95 are adapted to assume three positions: the first, when no sheet is being transported, the elements occupy their innermost position, the second, in a slightly outward position so that the projections 97 are positioned slightly away from the peripheral surface of the drum when a sheet has been registered as shown in FIG. 7, and third, with the projections 97 at a slightly greater distance from the periphery so as to move the leading edge of the sheet away from the drum periphery just prior to stripout of the sheet, as shown in FIG. 8.

Operating in close conjunction with the registration elements 95 are a plurality of gripper fingers 105 which are secured to the shaft 98 by means of clamps 106 and which extend through openings 107 formed in the periphery of the drum 20 in alignment with the openings 96 for the elements 95. As shown in FIG. 8, when viewing the drum 20 axially, the fingers 105 and the elements 95 are in alignment parallel to the axis of the drum. A spring 108 is held in tension between an anchor fixed to the interior of the cylinder 72 and a link 109 secured to the shaft 98 for normally biasing the elements 95 in their retracted or innermost position and the fingers 105 in their paper clamping position.

One end of the shaft 98 has a crank arm 110 secured thereto adjacent to and inwardly of the end cap 75. A connecting rod 111 secured to one end of the arm 110 projects through an opening 112 in the end cap 75, and is connected externally of the drum to a linkage system which will control the operation of the registration elements 95 and the gripper fingers 105.

The linkage system comprises a link member 113 pivotally mounted at one end by a pivot pin 114 to the upper end of the arm 81; a second link member 115 pivotally connected at one end to the free end of the link member 113; and a third link member 116 pivotally connected at one end to the free end of the link member 115. The link member 116 is secured intermediate its ends to a shaft 117 of a rotary solenoid SOL-3 mounted on the arm 81. When the solenoid SOL-3 is not energized, a spring (not shown) build into the solenoid will normally maintain the linkage in the position shown in FIG. 6. When the solenoid is energized, clockwise rotation is imparted to the link 116 thereby forcing the link member 115 downwardly and to the left causing clockwise rotation of the link 113 about the pivot pin 114. This position of the linkage system is shown in FIG. 4, with the solenoid energized. In effect, the pivot pin 114 and the solenoid shaft 117 supports the linkage system.

A cam lobe in the form of a detent 120 is formed on the inner edge of the link 113, and similarly the inner edge of the link 116 is formed with a cam lobe in the form of a detent 121. Actually, the inner edges of the links 113, 116 are camming surfaces as will be presently described, and the detent curves mainly control the camming effect of these edges. Each of the detents 120, 121 is adapted to cooperate for specific operation with a cam follower 122 in the form of a bearing race secured to the exterior end of the rod 111. During rotation of the transfer drum 20, the connecting rod 111 revolves about the axis of the drum since the shaft 98 and the opening 112 for the rod 111 move in a revolving motion about the axis. As the rod 111 revolves, it carries the cam follower 122 therewith in a circulating path having a predetermined radius with its center coincident with the axis of the drum 20 as illustrated by the letter P in FIGS. 4 and 6.

Figure 9:
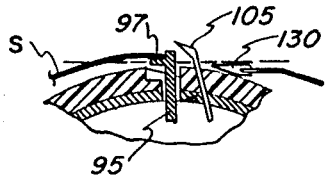
FIG. 9 is a cross-section of a detail of the drum just prior to stripout of the sheet.

In the condition of operation for effecting either single or multiple image transfer with the solenoid SOL-3 energized to move the linkage to its position shown in FIG. 4, the cam follower 122 (see dotted position) in its revolution along the path P will engage the inner edge of the link 116 at a point to the left of the shaft 117 which is in the path of movement of the follower for forcing the rod 111 inwardly. The follower makes contact with the adjacent end of the detent 121 which slows down radial movement of the rod 111 as it slides along the curve of the detent. Without this detent upon striking the edge of the link 116, the rod 111 would be propelled inwardly at too great a speed for the structural parts of the drum. The resultant movement of the rod 11 toward the axis of the drum is in opposition to the force provided by the spring 108 upon the shaft 98. The opening 112 is of a size sufficient to permit this limited movement of the rod 111 relative thereto. This slight inward movement of the rod 111 will produce slight rotation of the shaft 98, and consequently will produce slight outward radial movement of the registration elements 95 at the same time that the leading edge of a sheet of paper reaches these elements for registration thereby (see FIG. 7). At the same time, the gripper fingers 105 are rotated slightly out of the way to permit sheet registration. Immediately after registration, the solenoid SOL-3 is deenergized for multiple image transfer to allow the linkage to assume the position shown in FIG. 6 by virtue of the solenoid spring, and to allow the spring 108 to rotate the shaft 98 back to its original position. This movement produces outward movement of the rod 111 as it continues its revolving motion and out of the inner edge of the link 116. With the shaft 98 moved to its original position, it allows the registration elements 95 to assume their initial inactive condition and the fingers 105 to grip the leading edge of the sheet material thereby permitting transport and support of the sheet around the drum 20 (see FIG. 8 for this completed action). As the drum 20 rotates, it carries the leading edge of the sheet and the remaining portion thereof into the transfer station C to effect developed image transfer thereon. As the cam follower 122 continues its revolving movement and with the solenoid SOL-3 energized for single image transfer, the follower engages the inner edge of the link 113 at the leading end of the detent 120 and the rod 111 is driven inwardly again in a softened action as provided by the detent. The position of the link 113 is such that this inward movement of the rod 111 is greater than its inward movement provided by the detent 121. This action again rotates the shaft 98 against the spring force of the spring 108 except that the rotation is slightly larger than the initial rotation when the leading edge of a sheet was being registered. This additional rotation causes movement of the gripper fingers 105 out of contact with the leading edge of the sheet and additional clearance therefrom, and permits the projection 97 of the registration elements 95 to move the leading edge away from the periphery of the drum. A slight additional rotation of the drum will transport the leading edge of a sheet over the leading points of fixed stripout fingers 130 (see FIG. 9) and thereby remove the sheet from the drum as continued rotation thereof is made. As shown in FIG. 9, when the projections 97 have been moved to their outermost position for the stripout mode of operation to separate the leading edge of the sheet S from the drum, the leading points of the stripout fingers 130 are adapted to enter slightly below the surface of the projections 97 upon which the leading edge of the sheet S is placed.

Figure 6:
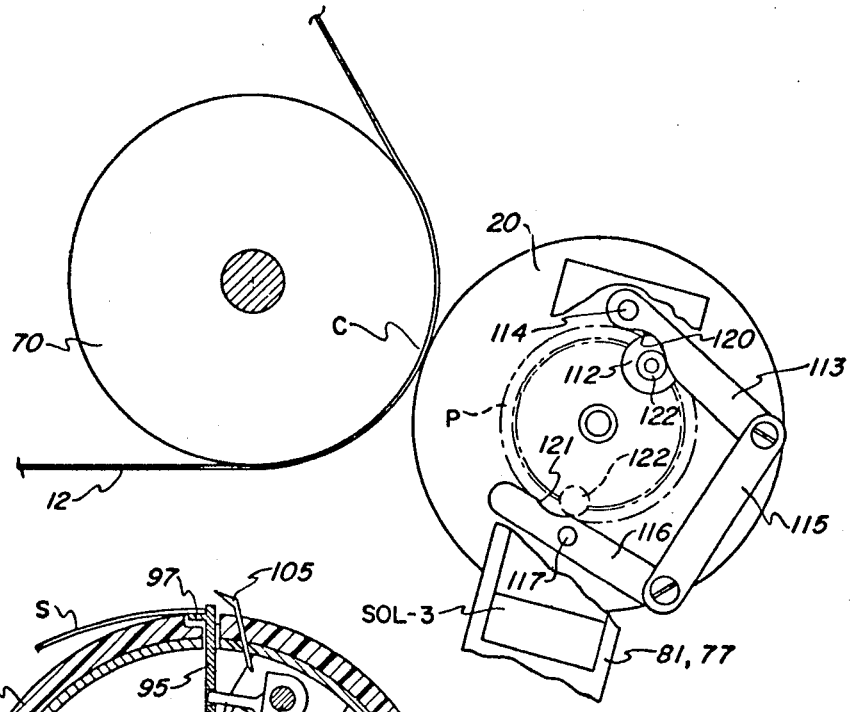
FIG. 6 is a cross-sectional view of the drum showing some parts in another condition of operation.

In operation, just prior to a sheet being fed to the drum 20, the linkage system comprising the links 113, 115, and 116 are arranged as shown in FIG. 6 wherein the detents 120 and 121 are positioned so that the cam follower 122 will not coact with either during a complete revolution. In the event that only one transfer is to be made per copy, say when black and white copies are being made, upon a sheet S being fed by the feeder 21, the solenoid SOL-3 is energized to bring the inner edge of the link 116 into the path of the follower 122. After the leading edge of the sheet is registered and gripped, the solenoid remains energized so that the follower may engage the detent 120 in order to produce sheet stripout. In the event a three color series of images have been produced and three transfers on the same sheet is to be accomplished, after the solenoid is energized to register and grip a sheet of support material, it is quickly deenergized, before the follower 122 can reach the link 113. In this event, the sheet cannot be stripped off the drum 20 as the camming surface of the detent 120 is held away from the path of movement of the follower and the sheet will remain on the drum until three image transfers have been completed. After the last transfer and when the follower 122 has passed the detent 121, the solenoid SOL-3 is again energized to position the linkage as shown in FIG. 4 in order to permit the follower to engage the inner edge of the link 113. As previously described, upon this occurrence, the sheet S will be stripped off the transfer drum as it continues its rotation. In summary, when the solenoid SOL-3 is energized, both camming detents 120, 121 are actuated into the path of movement P of the follower 122. When deenergized, both detents are actuated out of the path of the follower. For single image transfer copies, after registration, the solenoid remains energized. For multiple image transfer copies, after registration, the solenoid is deenergized and remains so until stripout.

For automatic operation, another sheet S of paper fed toward the drum by the paper sheet feed mechanism 21 will be registered and gripped by the elements 95 and 105 as these elements continue around to the paper register position of the drum 20. The paper feed mechanism working in automatic conjunction with the transfer drum registration and gripping mechanisms feed individual sheets of paper into pinch rollers 135 (see FIG. 1) which are arranged to feed the leading edge of the sheet at a greater speed than the circumferential speed of the drum 20 in order to permit the leading edge to contact the registration elements 95.

PROGRAMMING SYSTEM

The programming system for the machine illustrated in FIG. 1 is shown schematically in FIG. 10, and includes components previously described in relation to other figures of the drawings. The general operation of the machine will be described below as part of the programming system. A sequence of operation will be described which would only be a portion of the total operation of the machine and will refer only to those steps which are necessary to effect a three-color copy or, a black and white copy when color reproduction is not desired.

In order to commence operation of the machine, it will be assumed that the machine shown in FIG. 1 has been turned "On" and that all warm-up periods have terminated and the machine is in condition to reproduce copies of the original D. It is also assumed that power supplies for all the electrical components such as the charge corotron 14, the heater elements for the fuser 23, the power supply for the programming system, and drive motors for the augers 60, 61 for each of the developing units 16, 17, 18 and 19 and the sheet paper transports have been energized. For a single copy of a three color original, it will be assumed that the blue separation filter 27 has been moved in alignment with the lens 11 as part of the machine operation in a previous copy production run. To start color production, the main drive motor MOT-1 for the machine is energized. As shown in FIG. 10, this motor is connected to a gear box 150 which in turn is connected to the drive shaft 74 for the transfer roller 20 and to a pair of pulleys 151, 152, as part of the drive train for the machine. The motor is also connected by a shaft to a drive roller 153 for the belt assembly 13 for driving the belt 12 in its closed path of movement during a production run.

The pulley 151 is connected by a belt 154 to a larger pulley 155 mounted on a program shaft 156 upon which are mounted for rotation therewith a plurality of camming devices for operating associated switches in the programming system PS. The programming system PS includes the logic for the machine, its power supplies, timers, controls, selection devices for multiple copying and other components for the programming function, the effect of which will not be described. The pulley 152 is connected by a belt 157 to the pulley holding the filter disc 25. The relative size differential between pulley 151 and either the pulley 155 or the disc 25 is 3:1, for a three color reproducing operation such that the shaft 74 for the transfer drum 20 will make three revolutions for every revolution of the programming shaft 156. Upon energization of the motor MOT-1 the belt 12, the roller 20, the filter disc 25 and the programming shaft 156 will be continuously rotated in time related sequence in order to effect the automatic forming of a plurality of electrostatic latent images, one for each color rendition in the original, development of the images in proper sequence and proper transfer of each of the images in superimposed relationship upon a sheet of paper.

As the shaft 156 commences to turn, the first cam C-1 closes the switch S-1 for producing flash illumination of the lamp assembly 10 in order to expose the original D and effect the production of the first of a series of electrostatic latent images on the belt 12, this one corresponding to the yellow color and any component of yellow in a color mix in the original. As this latent image is moved around the roller 153 toward the first developing unit 16, the cam C-2 will have been moved to actuate the switch S-2 for imparting rotation to the drive shaft 43 for the yellow developer unit 16 and the cam C-3 will have been moved to actuate the switch S-3 for energizing the solenoid SOL-1 in this unit. Energization of this solenoid produces rotation of the magnet 46 to a position to permit the production of a magnetic blanket between the cylinders 41, 50 and, the rotation of the shaft 65 in a direction to remove the gate projection 66 away from the cylinder 50. The unit 16 is now in condition to apply yellow colored toner to the first electrostatic latent image approaching the unit which is representative of yellow color in the original.

As the motor MOT-1 continues to rotate and move the yellow latent image away from the exposure station A, the filter disc 25 rotates to present the green separation filter 28 into alignment with the projection lens 11 and the shaft 156 continues its slow rotation to cause the cam C-4 to actuate the switch S-4 to a closed condition for producing flash illumination by the lamp assembly 10 to produce a second electrostatic latent image on the belt 12, this one in accordance with the red color and mix thereof in the original. Immediately after this second flash illumination with the programming shaft 156 still in rotation, the cam C-5 will close the switch S-5 for energizing the paper feed mechanism 21 in order to separate and move a sheet S of paper into the nip of the pinch rollers 135 and then against the periphery of the transfer roller 20.

As the second latent image, indicative of the red color moves out of the exposure station A and toward the development station and as the first latent image being developed is moved away from the influence of the yellow developing unit 16, the cams C-2 and C-3 will have been moved to positions to permit the opening of the switches S-2 and S-3 respectively in order to terminate rotation of the shaft 43 and consequently the cylinders 41, 50. Opening of the switches S-2, S-3 also serves to deenergize the solenoid SOL-1 for turning the magnet 46 in a position to gate the brush 40 and to rotate the scrapper gate 64 thereby inactivating the developing unit 16. As the first latent image is completely moved past the cyan developing unit 17, the shaft 156 would have rotated sufficiently to cause the cam C-6 to close the switch S-6 for commencing the rotation of the brush rollers for this unit, and for the cam C-7 to close the switch S-7 for energizing the solenoid associated therewith for permitting a magnetic blanket to be formed and operating in this unit.

As the second latent image is moved in the vicinity of the developing unit 17, cyan color toner will be applied to this image thereby developing the same. At this time also, the cam C-8 will close the switch S-8 for energizing the solenoid SOL-3 associated with the transfer drum 20. The cam follower 122 contacts the inner edge of the link 116 for causing registration of the sheet of paper and gripping thereof by the gripping fingers 105. This energization of the solenoid SOL-3 is momentary as the fingers 105 being spring biased into gripping position will maintain the sheet on the drum 20 only when the solenoid is so deenergized. As the sheet is moved into the line of contact between the roller 20 and the belt 12, the shaft 156 would have been rotated to permit the cam C-9 to close the switch S-9 to connect the blanket 71 on the transfer drum 20 to a source of electric bias potential just immediately prior to the movement of the yellow developed image to the transfer station.

As the drive motor continues to rotate and the filter disc 25 continues to rotate, the green filter 29 is brought into position in optical alignment with the lens 11. The continued rotation of the shaft 156 will allow the cam C-10 to close the switch S-10 in order to produce flash illumination by the lamp assembly 10 and thereby produce a third electrostatic latent image, this one in accordance with the green colors or mixtures thereof in the original. As this third image starts to move toward the developing zone and the second has been completely developed by the unit 17, the cams C-6 and C-7 would have permitted the opening of the switches S-6 and S-7, respectively, in order to inactivate the unit 17. By this time the first developed image, the yellow colored image, would have been completely transferred to the sheet of paper S. This action is timed with the movement of the cam C-9 away from the switch S-9 in order to terminate the supply of electrical bias to the transfer drum 20 for this yellow transfer biasing function. Continual rotation of the programming shaft 156 will cause the cams C-11 and C-12 to close the switches S-11 and S-12 for actuating the magnetic developer unit 18 by means of the same structure that was actuated for each of the two previously described units 16 and 17. Next in the cycle of operation, the cam C-13 will actuate the switch S-13 and connect the transfer drum 20 to the source of electrical bias supply at the time that the cyan color developed image is in position and in registration with the sheet of paper S being recirculated by the drum 20 in the second transfer operation. Continued rotation of the shaft 156 will allow the cam C-13 to release the switch S-13 to terminate the supply of transfer bias as the second latent developed image has been fully transferred to the sheet. Immediately behind the second developed image, the magenta color developed image is ready for transfer and the cam C-14 will actuate the switch S-14 for connecting the drum 20 to the source of electrical bias for permitting the transfer of the third and last image.

As the production cycle nears its end, further movement of the cams C-11 and C-12 will permit the associated switches S-11 and S-12 to open again for inactivating the magenta developing unit 18, by terminating the existence of a "magnetic blanket" relative to the cylinders 41, 50, this being accomplished by gating the continued existence of the magnetic blanket. A second cam lobe on the cam C-8 will reactivate the switch S-8 to produce energization of the solenoid SOL-3 at about the same time that the cam follower 122 is approaching the inner edge of the link 113. This energization as the drum 20 continues its rotation will cause the stripping out of the sheet of supply material from the drum by the fingers 130 and permit the sheet to move toward the fuser 23 for fixing the three superimposed developed images. As the sheet leaves the contact line between the drum 20 and the belt 12, the cam C-14 will allow the switch S-14 to open for terminating the electrical bias on the drum 20.

The foregoing sequence of operation was described for producing a single copy utilizing a three color reproduction process. If more than one copy is to be made in a given reproduction run, the sequence will overlap, which means that the blue filter 27 would be moved into position prior to the first exposure for the second series of exposures of the original D. Throughout the sequence of operation, the filter disc 25 was moved in a continuous slow manner and the neutral density filter 30 is not utilized in the three color reproduction process. After the last filter 29 has been utilized with magenta development, the disc 25 is moved to present the filter 27 for the first exposure in the reproduction of a second copy. The filter 30 is utilized for the reproduction of the original D in black and white only. For black and white reproduction, the programming system and supply PS is arranged to maintain the filter 30 in position for all exposures and the solenoid SOL-3 energized in order to control the drum 20 linkage system so that each sheet is registered, gripped and, after transfer, stripped from the drum.

The relative sizes between the aperture for the lens 11 and each of the separation filters is such that one of the filters will always be in position at the precise instant of a flash exposure. It will be understood that a suitable stop and go indexing arrangement could be substituted for the pulley and belt drive means for the filter disc. Similarly, some of the switches actuable by the programming shaft 156 may be combined by utilizing a plurality of cam lobes on each cam for actuating some of the switches. For example, the electrical bias producing switches S-9, S-13 and S-14 may be combined into one switch operable by a cam having three lobes, one for each of the bias producing events or, the flash illumination of the original to produce a series of three latent images may be acquired by combining the cams C-1, C-4 and C-10 into one cam with three lobes.

While the invention has been described with reference to the structure disclosed herein, it is not confined to the details set forth, but is intended to cover such modifications or changes as may come within the scope of the following claims.

What is claimed is:

1. A method for producing multi-color reproductions of an original comprising the steps of:

forming a series of electrostatic latent images of the original side by side on the surface of a photoconductive plate member as the same moves along a predetermined path, each image in said series corresponding to a light pattern of a different color and together forming a multi-color reproduction of the original, developing said images by advancing each image into contact with an applicator for developing material having a subtractive color relative to the color of which the respective image was formed, recirculating support material into contact with the plate member for each developed image in said series, and transferring each developed image of said image series upon the support material as the same is moved into contact with the plate member whereby to form said multi-color reproduction.

2. A method for producing multi-color reproductions of an original comprising the steps of:

forming a series of electrostatic latent images of the original in a row on the surface of a photoconductive plate member as the same moves along a predetermined path, each of said images corresponding to a light pattern of a different color, moving said series of images adjacent a plurality of developing units each of which is adapted when activated to apply developing material to one of the images in said series, the developing material for each unit having a subtractive color relative to the color of the image being affected hereby, and activating said units in accordance with the movement of each latent image into a position adjacent the development unit associated therewith to be developed thereby.

3. The method of claim 2 including the step of transferring the developed images directly to a support material in superimposed relationship and in a single operation.

4. A method for producing multi-color reproductions of an original comprising the steps of:

sequentially forming a series of electrostatic latent images of the original side by side on the surface of a photoconductive plate member as the same moves along a predetermined path, each of said images corresponding to a light pattern of a different color, sequentially developing said images by advancing each image into contact with an applicator for developing material having a subtractive color relative to the color of which the respective image was formed, introducing a sheet of support material into a closed path of movement and at a predetermined position in this path, moving the sheet in said closed path and in contact with the plate member once for each developed image in said series wherein orientation of the sheet relative to each developed image will be the same, and transferring each developed image upon the support material as the same is moved into contact with the plate member.

* * * * *